United States Patent [19]

Kirn et al.

[11] 4,203,859

[45] May 20, 1980

[54] SOLUBILIZED ACRYLIC POLYMERS AND CARPET SHAMPOOS CONTAINING THE SAME

[75] Inventors: William A. Kirn, Abington; David R. Gehman, Harleysville, both of Pa.

[73] Assignee: Rohm and Haas Company, Philadelphia, Pa.

[21] Appl. No.: 898,571

[22] Filed: Apr. 21, 1978

Related U.S. Application Data

[63] Continuation-in-part of Ser. No. 810,216, Jun. 27, 1977, abandoned.

[51] Int. Cl.[2] ..... C11D 3/37

[52] U.S. Cl. ..... 252/174.23; 252/89.1; 252/545; 252/DIG. 2; 252/DIG. 3; 252/DIG. 13; 252/DIG. 15; 8/137; 134/4

[58] Field of Search ..... 252/89 R, 545, DIG. 2, 252/DIG. 3, DIG. 13, DIG. 15, 88; 427/390 E; 8/137; 260/29.6 R; 134/4

[56] References Cited

U.S. PATENT DOCUMENTS

| | | | |
|---|---|---|---|
| 3,723,358 | 3/1973 | Morgan et al. | 252/DIG. 2 |
| 3,994,744 | 11/1976 | Anderle et al. | 134/4 |
| 4,002,571 | 1/1977 | Anderle et al. | 252/DIG. 2 |
| 4,013,595 | 3/1977 | Podella et al. | 252/545 |

*Primary Examiner*—Mayer Weinblatt

[57] ABSTRACT

As a modifier for carpet shampoos and the like, an aqueous composition containing a polymer component comprising an aqueous dispersion of an acrylic polymer, polyvalent metal ions, ammonia or a volatile amine to solubilize the copolymer, and optionally $CO_3$=, $HCO_3$— or an anion of an amino acid. The acrylic polymer is a low molecular weight copolymer of 20–60 parts butyl acrylate, 0–25 parts styrene, 0–15 parts methyl methacrylate, and 40–60 parts of at least one of methacrylic acid, acrylic acid, and itaconic acid. Preferably the polymer contains at least about 5 parts of styrene, the styrene:butyl acrylate ratio being no more than 1:1. The pka of the polymer component is less than about 6.7 and the number average molecular weight of the polymer is about 2500–100,000. The viscosity in centipoises at 25% solids of polymer in water at 35° C. and containing at least two equivalents of ammonium cation and at least 0.8 equivalents of zinc as zinc oxide, is preferably below 3,500 cps, more preferably below 1,500 cps.

15 Claims, No Drawings

SOLUBILIZED ACRYLIC POLYMERS AND CARPET SHAMPOOS CONTAINING THE SAME

BACKGROUND OF THE INVENTION

This application is a continuation-in-part of U.S. application Ser. No. 810,216 filed June 27, 1977 and abandoned as of the filing of this application.

This invention concerns modifiers for carpet and other shampoos, and more particularly concerns an improved acrylic copolymer shampoo modifier which includes polyvalent metal compounds which ionically crosslink carboxyl groups in the polymer.

It is known to utilize acrylic polymers as modifiers for carpet shampoos and metal ions such as zinc for crosslinking of the polymer. Examples of the prior art include U.S. Pat. Nos. 3,723,323, 3,723,358, 3,994,744 and 3,901,727. Ionic crosslinking of similar polymers has been used in other environments such as floor polishes. In this regard, patents of interest include British Pat. No. 1,173,081 (corresponding to U.S. Pat. No. 3,457,208), U.S. Pat. Nos. 3,308,078, 3,328,325 and 3,554,790. Other patents that are concerned with carpet shampoos include U.S. Pat. Nos. 3,761,223, 3,775,052, 3,911,010 3,835,071, 3,994,744 and 4,002,571. Many of the noted patents include utilization of polyvalent metals including zinc, zirconium, cobalt, copper, cadmium, calcium, magnesium, nickel and iron, all of which are useful in the present invention, to ionically crosslink the polymers. The utilization of a chelate of a polyvalent metal ion and a bidentate amino acid ligand is disclosed in U.S. Pat. No. 3,554,790, noted above, and particularly in floor polishes. These complexes are useful in the present invention and include complexes with aliphatic or heterocyclic amino acids such as glycine, alanine, $\beta$-alanine, valine, norvaline, $\alpha$-aminobutyric acid, leucine, norleucine, n-methylamino acetic acid, n-ethylamino acetic acid, dimethylamino acetic acid, diethylamine acetic acid, proline, phenylalanine, and others disclosed in said patent.

It has now been discovered that utilizing a particular polymer composition having critical ratios of certain monomers, critical molecular weights, a critical maximum pka, a critical ratio of polyvalent metal ions to carboxyl groups, and the like, gives a much improved shampoo modifier, and an improved shampoo. For example, polymers with substantial proportions of isobutyl acrylate in place of butyl acrylate, ethyl acrylate in place of butyl acrylate, methyl methacrylate in place of butyl acrylate or styrene, or butyl methacrylate in place of butyl acrylate, give relatively poor or only fair soil retardancy, or do not provide stable solutions in the presence of large quantities of a detergent such as sodium lauryl sulfate, at a representative polymer: detergent ratio of 1:1 by weight.

SUMMARY

The improved shampoo modifier of the invention is an aqueous composition containing: (1) a polymer component comprising an aqueous dispersion of a low molecular weight acrylic addition copolymer consisting essentially of polymerized units of (a) butyl acrylate, (b) styrene, (c) methyl methacrylate, and (d) an acid monomer selected from methacrylic acid, acrylic acid, itaconic and any mixture of two or more thereof, in the ratios by weight of 20–60/0–25/0–15/40–60, the polymer having a number average molecular weight of between about 2,500 and 100,000; (2) polyvalent metal ions; (3) ammonia or a volatile amine; and (4) optionally, an anion in the form of $CO_3^{=}$, $HCO_3^{-}$ or the anion of an amino acid. The pka of the polymer component is less than about 6.7 and the polymer contains no more than about 1 part of styrene to 1 part of butyl acrylate by weight. The pH of the composition is between about 7.5 and 11, there being at least about 0.8 equivalents of polyvalent metal ion per carboxyl group in the polymer. In addition to being used in an amount to solubilize the polymer, the amount of the ammonia or volatile amine will also be selected to solubilize the polyvalent metal or polyvalent metal compound which supplies the metal ions, if the metal compound is insoluble or only marginally soluble.

PREFERRED EMBODIMENTS-DETAILED DESCRIPTION

The polymer of the aqueous composition preferably contains at least about 5%, more preferably at least about 10%, of styrene. The preferred molecular weight is from about 10,000 to about 70,000 and preferably the equivalents of polyvalent metal ion per carboxyl group in the polymer is at least 0.9. More particularly preferred are compositions in which the metal is zinc, an anion is present as carbonate, bicarbonate or amino acid anion (such anions sometimes being termed "ligands"), the acid monomer is methacrylic acid, and the viscosity of a 25% solids solution of the polymer in water, at 35° C., the polymer solution containing at least two equivalents of ammonium cation and at least one equivalent of zinc as zinc oxide, preferably is below about 3,500 centiposes, more preferably below about 1,500 centipoises. As noted below, when using more dilute solutions, or when using the latex directly, the viscosity of the solubilized polymer is not as important. However, if the solubilized polymer is to be handled, pumped, shipped, etc., at a solids content of greater than 15%, viscosity control is important.

The volatile amines include the lower alkyl ($C_1$–$C_4$) monoamines such as methyl amine, dimethylamine, ethylamine, diethylamine, diethylamine, and triethylamine. The optional anions further stabilize any complex formed with the polyvalent metal ions and ammonia or volatile amine and the amounts of the anions may be selected for such purpose. Generally, stoichiometric amounts or slight excesses over stoichiometric amounts (relative to the polyvalent metal) of the anions will be suitable.

The modifier composition is blended with a detergent such as sodium lauryl sulfate to form a shampoo for carpets or other surfaces, the weight ratio of detergent to modifier composition solids being between about 90:10 and 1:99, preferably about 20–70 parts detergent and the balance to make 100 parts modifier composition. While the modifier composition alone provides some cleaning efficacy, it is more effective and more economical to admix it with known detergents and/or builders commonly employed in shampoos. Moreover, although the present invention is directed primarily to carpet shampoos, the modifier composition is also suitable alone or in admixture with detergents for the shampooing of various other surfaces such as upholstery, draperies, textiles, and hard surfaces including terrazo and vinyl or asbestos tiles.

Other suitable detergents include naphthalene sulfonates, aliphatic ether sulfates, sulfosuccinates and sarcosinates, all being well known anionic detergents for carpet shampoos as indicated in the aforementioned patents.

The method of cleaning using the modifier composition or shampoo containing the modifier essentially comprises applying the modifier or, more usually, a shampoo containing the modifier composition, to a substrate to be cleaned and then removing the residue of the modifier composition or shampoo together with loosened soil. Depending on the manner in which the modifier or shampoo is applied, the residue may be removed by scrubbing, vacuuming, sweeping, brushing, or rinsing. Typical shampooing systems are scrubbing machines, steam or hot water cleaning machines, and aerosol applicators. In steam or hot water cleaning, the residue of modifier and shampoo together with soil is removed as an aqueous phase by vacuuming. The modifier or shampoo may also be permitted to dry on the surface to a hard, friable film and the residue then removed by vacuuming. More information on the foregoing techniques as well as representative shampoos which may be improved by the modifiers of the invention may be found in the published literature such as the article by L. R. Smith, "Recent Trends in Carpet Shampoos", Household & Personal Products Industry, October, 1976, page 36.

One of the major benefits of the invention is improved soil retardancy by reason of more complete extraction of detergent with other residue, thereby reducing the possibility of soil entrapment in the detergent due to the hydroscopic nature of detergent ingredients under the conditions of high humidity normally present during shampooing. Soil retardancy is further improved by entrapment of a residuum of modifier composition in the interstices of the substrate (such as carpet yarn), thereby blocking polar receptor sites for soil.

As noted the polymer consists essentially of the specified monomers in the specified ratios. Accordingly, minor amounts, usually less than about 5%, of other addition polymerizable ethylenically unsaturated monomers may be included, if the basic characteristics of the polymer are not changed.

Known polymerization procedures are utilized for preparing the polymer. Emulsion polymerization is preferred, although the polymer can also be made by other techniques such as solution or suspension polymerization. However, a larger than usual amount of a chain transfer agent is utilized to lower the molecular weight, low molecular weight being a critical parameter of the polymers. A typical emulsion polymerization procedure involves the utilization of 3% bromotrichloromethane, based on monomers, as a chain transfer agent, sodium lauryl sulfate as the emulsifier, and ammonium persulfate as the initiator. The monomers amount to about 10% to 45% preferably at least about 20%, of the aqueous emulsion and are polymerized by a conventional procedure. The polymer solids content may range widely, on the order of about 5–50% by weight, preferably about 10–40%. A typical polymer composition has 15–20% polymer solids.

The upper limit of the solids content of the modifier composition is dictated by the viscosity which must be low enough to allow handling, e.g. pumping, the polymer solution. If the polymer is in latex or emulsion form and the modifier composition is directly formulated into a carpet shampoo, the viscosity requirements are not as stringent. The reason for this is that latices have convenient viscosities at high solids contents, and if solubilized and used directly to form carpet shampoos, need not be substantially diluted. But in cases in which the solubilized polymer is shipped or handled as such at a solids content of greater than about 15%, the viscosity is critical. Of course, higher solids polymers are more economical to manufacture and ship.

Conventional foaming agents and surfactants known in the art for carpet and other shampoos are useful in accordance with the present invention. Typical classes of detergents include polyoxyalkylene alkyl alcohol sulfates, polyoxyalkylene alkyl carboxylates, polyoxyalkylene alcohol phosphates, alkali metal ammonium salts of fatty acids, alcohol sulfates, alcohol phosphates, alkyl sulfonates, alkyl phosphates, and the like. Typical surfactants are sodium lauryl sulfate, magnesium lauryl sulfate and ammonium lauryl sulfate. Typical foam stabilizers are sodium lauryl sarcosinite (particularly preferred for obtaining films which dry to a non-tacky, friable state), diethanolamine laurate, and lauryl dimethylamine oxide. Small amounts of coalescents may be utilized, typical ones being the "Cellosolve" materials and the "Carbitol" materials. Detergent builders such as trisodium phosphate may also be used, as is known. The usual additives include perfumes, optical brighteners, deodorizers, bacteristats, and others.

While the metal may be added as a soluble salt, such as zinc ammonium carbonate, some compounds such as zinc oxide release enough metal ions in solution to function to provide the crosslinking ions. Typical metals are cadmium, nickel, zinc, zirconium, cobalt, copper and so forth as disclosed in the patent specifications mentioned earlier.

Practically any carpet material may be cleaned utilizing the modifier compositions and shampoos of the invention, including wool, nylon, cotton, acrylics, polyesters and blends. Moreover, other surfaces both hard and soft may be cleaned using the compositions such as tile and terrazo floors, upholstery, drapery, and other textile fabrics.

In the following examples and tables, the designation "C" followed by an example number indicates a comparative example, that is, an example outside the invention.

It is to be noted that the identically same polymer may give different results in different tables. There are several reasons for this. The carpet samples were taken from the same roll of carpeting, which should not cause appreciable variations. However, the carpet samples are conditioned in a chamber in which the relative humidity and temperature are theoretically kept at 28° C. and 98% relative humidity. Unfortunately, these conditions cannot always be precisely controlled, and different batches of carpet samples from time to time receive varying conditions of relative humidity in temperature. Additionally, some samples could be subjected to slightly different conditions of shampooing, to different conditions of drying, and to different conditions of removal of residue. It is to be noted that within each of the tables in the following examples the different carpet samples were, as nearly as possible, identically conditioned, shampooed, dried and vacuumed by the same operator. Thus, the results within a given table are comparable with one another whereas in some instances the results using the same polymer as reported in different tables are not strictly comparable, but nevertheless indicate relative levels of effectiveness.

PREPARATION OF MODIFIER COMPOSITION

Part A: Polymer Component

A 5 liter, 4-neck round bottom flask fitted with a condenser, stirrer, thermometer and three addition funnels or addition pumps was charged with 1,118 g. deionized water and 39.3 g. of 28% aqueous sodium lauryl sulfate. A nitrogen stream was passed over the solution and the flask was heated to 87° C. A monomer emulsion was prepared in a separate flask by combining 300 g. deionized water, 5.7 g. of 28% aqueous sodium lauryl sulfate, 352.8 g. butyl acrylate, 151.2 g. styrene and 504 g. methacrylic acid. The mixture was stirred or shaken after each addition to form a stable emulsion. An activator solution was prepared by dissolving 9.0 g. of 35% hydrazine in 81 g. of deionized water. An initiator solution was prepared by dissolving 28.8 g. of 70% t-butyl hydroperoxide in 201 g. of deionized water.

When the kettle charge reached 87° C., 66 g. of the monomer emulsion was added followed by 28.8 g. of 70% t-butyl hydroperoxide, 0.214 g. cuprous chloride in 15 g. deionized water, and 13 ml. of the activator solution. The mixture was stirred for 10 minutes as the temperature returned to 87° C.

The monomer emulsion, initiator solution and activator solution were added evenly over a 150 minutes period while the temperature was maintained at 87° C. After the additions the temperature was maintained at 87° C. for an additional 30 minutes and then cooled. The product was filtered through cheesecloth and the conversion was determined by drying a 1 g. sample for 30 minutes in a 150° C. oven. Theoretical solids was 36.0%.

Part B: Metal Crosslinker Composition

A 3 liter, 4-neck round bottom flask fitted with a condenser, stirrer, thermometer, and addition funnel was charged with 453.6 g. of zinc oxide, 438.9 g. of ammonium bicarbonate and 1,008 g. deionized water. The slurry was stirred and cooled to 15°-20° C. Concentrated ammonium hydroxide (1,050 g.) was added over a 1.25 hr. period, keeping the temperature below 20° C. with cooling. A clear solution of the zinc ammonium bicarbonate was obtained.

Part C: Shampoo Modifier

A 3 liter 4-neck round bottom flask fitted with a condenser, stirrer, therometer and addition funnel was charged with 850 g. of the zinc ammonium bicarbonate solution from Part B, 210 g. of concentrated ammonium hydroxide and 55 g. of butyl Cellosolve. The emulsion from Part A (1,625 g.) was added with stirring over a 25 minutes period. The temperature of the reaction increased about 14° C. as the emulsion dissolved. The solution was stirred an additional 15 minutes. The product was slightly hazy and had a theoretical solids of 25%. The Brookfield viscosity (spindle #3, 12 rpm) was 1650 cps at 29.5° C. The modifier was utilized in the test procedures below as Example 49 of Tables XIII and XV.

In the examples the abbreviations used have the following meanings:

BA:butyl acrylate
MAA:methacrylic acid
iBA:isobutyl acrylate
EA:ethyl acrylate
St:styrene
HEMA:hydroxyethyl methacrylate
BMA:butyl methacrylate
t-BHP:tertiary butyl hydroxyperoxide
BTM:bromotrichloromethane
3-MPA:3-mercaptopropionic acid
APS:ammonium persulfate
SLS:sodium lauryl sulfate
Tg:The glass transition temperature of the polymer as calculated Typically the foregoing monomers are 85-99.5% pure. Common impurities are higher molecular weight unsaturated materials, aliphatic acids, and the like.

ACCELERATED LABORATORY BENCH TEST METHOD

A. Introduction

In order to define a true cleaning and soil retardancy profile for a carpet shampoo formulation, a series of accelerated bench tests are conducted on both presoiled carpet and carpet preshampooed with the candidate shampoo. The presoiled carpet is cleaned with the candidate shampoo and evaluated to determine initial cleaning efficacy. The sample is then resoiled and again evaluated to determine resoil retardancy. The preshampooed carpet is soiled and evaluated to determine initial soil retardancy. The sample is then recleaned and evaluated to determine recleanability.

B. Laboratory Bench Soiling Technique

The piece of carpet to be evaluated is placed in a one gallon ball mill and is affixed to the periphery with double faced tape. The mill with the lid removed is permitted to condition at 90% RH and 25° C. for two hours prior to testing. After this period an AATCC soiling capsule containing five grams of AATCC synthetic carpet soil as well as fifteen one inch and fifteen ½ inch carborundum balls are placed in the mill and the lid is affixed. The mill is rotated at 60 rpm for five minutes in each direction on a ball milling apparatus. During this period the soil is uniformly spread on the carpet and ground in by the impinging action of the balls against the carpet. The carpet is then removed from the mill and vacuumed lightly to remove loose soil.

It should be noted that high relative humidity conditioning of treated carpet samples prior to soiling is an extremely important phase of these test procedures. The hygroscopic nature of the residual surfactant which remains on the carpet after the cleaning operation is the prime contributor to accelerated carpet resoiling. The high relative humidity conditioning environment provides a clearer perspective of the resoiling characteristics of the carpet after shampooing.

C. Method for Laboratory Bench Shampooing of Carpet

A carpet section measuring 11.5×14.5 cm is cordoned with masking tape. The shampoo is applied at 2% use dilution from a volume of 20 mls and scrubbed into the carpet section using an ASTM brush for 10 seconds in each of two directions. The shampooed carpet is permitted to dry overnight and is then vacuumed using a home vacuum cleaner.

In the following examples, two samples of white nylon loop pile carpet are used in the evaluation technique. One sample is pretreated with the various shampoos using an industrial carpet scrubbing machine, then soiled under foot traffic for two weeks and carefully evaluated for soiling. A second sample is presoiled for two weeks prior to application of the shampoos, shampooed, again using an industrial scrubber, and evaluated for cleaning efficacy. This sample is again placed under traffic and evaluated for resoiling. A visual subjective panel of eight persons is selected to evaluate and rate the carpet samples with ratings from one to three with a rating of three being the best. Hence, a subjective rating of 24 would indicate that all panel members selected that section as the best. Instrumental evaluations using the reflectometer are also recorded to determine percent soil retardancy and percent cleaning efficacy.

Standard test methods are employed. Two equations are presented below which derive values for percent soil retardancy and percent cleaning efficacy from the observed reflectance value, K. The reflectance value is determined by ASTM Method D-2244, 9.2.4.5, System C using a Hunter Tristimulus Reflectometer.

These equations are:

$$\text{Percent Soil Retardancy} = \frac{K\,(\text{untreated soiled}) - K\,(\text{treated soiled})}{K\,(\text{untreated soiled}) - K\,(\text{untreated unsoiled})} \times 100$$

$$\text{Percent Cleaning} = \frac{K\,(\text{untreated soiled}) - K\,(\text{soiled cleaned})}{K\,(\text{untreated soiled}) - K\,(\text{untreated unsoiled})} \times 100$$

Using the soil retardancy equation, the higher the computed percentage the better the soil retardancy of the formulation. Zero percent soil retardancy indicates that the treated carpet soils at the same rate as untreated carpet. Negative values indicate an accelerated soiling rate compared to untreated carpet.

Using the equation for calculation of cleaning, again the higher the percentage the better the cleaning efficacy of the formulation. Zero percent cleaning indicates that the formulation offers no improvement in carpet appearance.

In the following examples, standard carpet shampoo formulations were prepared at a modifier/sodium lauryl sulfate (SLS) weight ratio of 2.5/1. The results detailed in Table I demonstrate the BA (Example 1) to be clearly superior to the EA (Example C4) and BMA (Example C8) analogs in initial and resoil retardancy. The negative resoil retardancy value reported for the EA analog indicates that this system actually accelerates resoiling faster than untreated carpet. The poor performance of this system is a result of the relative hydrophilicity of the EA in the backbone. The presence of hydrophilic monomers such as HEMA and MA are detrimental to the soil retardancy of the modifier, since they are subject to softening by conditions of high relative humidity, and thus increase soil adherence to the carpet. Table I also demonstrates that n-BA (Example 1), offers a soil retardancy and cleaning performance advantage over an i-BA analog (Example C2) and a higher molecular weight n-BA analog (Example C3), made with a recipe containing a lower level of BTM, a chain transfer agent. Higher molecular weight analogs compromise soil retardancy and cleaning performance, since penetration of the shampoo into the microscopic interstices and voids in the carpet filament is inhibited.

Maintaining the acid monomer level at 50% and incorporating 25% BA into the backbone, a series of modifiers was prepared which incorporated various high Tg monomers. The data presented in Table I shows the soil retardancy superiority of BA/styrene (Example 5) over BA/styrene/MMA (Example 6), and BA/MMA (Example 7). This BA/St analog of Example 5 also demonstrates superior soil retardancy and cleaning over an MMA/St analog (Example C9). It may be concluded that this BA/St copolymer analog demonstrates the best overall performance profile of any system evaluated in Table I. This data is of interest since it shows that no direct causal relationship exists between comonomer Tg and soil retardancy. As noted hereinbelow, the level of styrene in Example 5 gives unacceptably high viscosities for some applications, however.

TABLE I

Effect of Monomer Selection on Performance
All Systems Formulated at 2.5/1 Modifier/SLS Ratio

| Example | Compositions[1] | BTM Level | Tg[2] °C. | % Soil Retardancy[3] Initial | % Soil Retardancy[3] Resoil | % Cleaning[4] Initial | % Cleaning[4] Reclean |
|---|---|---|---|---|---|---|---|
| 1 | BA/MAA//50/50 | 2.0% | 21 | 47 | 44 | 64 | 88 |
| C2 | iBA/MAA//50/50 | 2.0% | 21 | 45 | 27 | 48 | 77 |
| C3 | BA/MAA//50/50 | 1.25% | 21 | 42 | 38 | 60 | 82 |
| C4 | EA/MAA//50/50 | 2.0% | 50 | 24 | −15 | 65 | 86 |
| 5 | BA/St/MAA//25/25/50 | 2.0% | 70 | 52 | 53 | 65 | 86 |
| 6 | BA/St/MMA/MAA//25/15/10/50 | 2.0% | 70 | 42 | 42 | 64 | 87 |
| 7 | BA/MMA/MAA//25/25/50 | 2.0% | 71 | 39 | 19 | 57 | 84 |
| C8 | BMA/MAA//50/50 | 2.0% | 81 | 39 | 33 | 62 | 88 |
| C9 | MMA/St/MAA//25/25/50 | 2.0% | 114 | 39 | 40 | 63 | 82 |

[1]All polymers contain 1.0 eq. $Zn^{++}$ complexed with ammonia
[2]Calculated glass transition temperature of polymer without regard to actual effect of zinc, which makes polymer more brittle.

SEQUENCE OF CARPET EVALUATION STEPS

| [3]Soil Retardancy | [4]Cleaning |
|---|---|
| a. Preshampoo | a. Presoil |
| b. Soil | b. Shampoo |
| c. Evaluate for percent soil retardancy, initial | c. Evaluate for percent cleaning, initial |
| d. Reclean | d. Resoil |
| e. Evaluate for percent cleaning, reclean | e. Evaluate for percent soil retardancy, resoil |

TABLE II

| Example | Modifier /SLS | Percent Soil Retardancy Initial | Percent Soil Retardancy Resoil | Percent Cleaning Initial | Percent Cleaning Reclean |
|---|---|---|---|---|---|
| C-10 | 3.4/1 | −71 | −55 | 66 | 44 |
| C-11 | 2.5/1 | 1 | −25 | 63 | 65 |
| 12 | 2.5/1 | 52 | 33 | 71 | 70 |

TABLE II-continued

| Example | Modifier /SLS | Percent Soil Retardancy Initial | Percent Soil Retardancy Resoil | Percent Cleaning Initial | Percent Cleaning Reclean |
|---|---|---|---|---|---|
| C-13 | 2.5/1 | 46 | 22 | 69 | 67 |

Actual service soiling and cleaning evaluations were conducted. Included for control purposes were two commercial shampoo formulations found to offer the best balance of soil retardancy and cleaning efficacy. These were "Morton SRP-30" (Example C-11), a fluoroacrylate/methacrylate high Tg water soluble polymer sold by Morton Chemical Company, and "Vanguard" (Example C-10), a high Tg acrylic emulsion copolymer of MMA/MAA sold by Polyvinyl Chemical. Each was formulated in accordance with instructions in their respective product data sheets. Examples 12 and C-13, prepared similarly to Example 49, are Ba/St/MAA 25/25/50 ($\bar{M}n$ about 50,000) and MMA/MAA 80/20 ($\bar{M}n$ about 2,500) plus 1 eq. of $Zn^{++}$, respectively. Although not within the present invention C-13 demonstrates the importance of molecular weight (see Table V), monomer identity, and metal crosslinking.

Of noteworthy interest in comparing the two series of the following examples (Table III) is the dramatic decrease in overall soiling of the pretreated carpet versus the presoiled analog.

TABLE III

Service Soiling and Cleaning Evaluation

A. Presoiled

| Examples | Modifier /SLS | First Cleaning % Cleaning | First Cleaning Subjective | Second Soiling % Soil Retardancy | Second Soiling Subjective | Second cleaning % Cleaning | Second cleaning Subjective | Third Soiling % Soil Retardancy | Third Soiling Subjective |
|---|---|---|---|---|---|---|---|---|---|
| C-10 | 3.4/1 | 15 | 19 | 8 | 12 | 25 | 10 | 35 | 23 |
| C-11 | 2.5/1 | 6 | 15 | 8 | 18 | 18 | 24 | 29 | 19 |
| 12 | 2.5/1 | 18 | 32 | 20 | 32 | 27 | 32 | 35 | 30 |
| C-13 | 2.5/1 | 21 | 10 | 13 | 18 | 22 | 15 | 26 | 8 |

B. Pretreated

| Example | Modifier /SLS | First Soiling % Soil Retardancy | First Soiling Subjective | Second Cleaning % Cleaning | Second Cleaning Subjective | Second Soiling % Soil Retardancy | Second Soiling Subjective |
|---|---|---|---|---|---|---|---|
| C-10 | 3.4/1 | 50 | 18 | 69 | 13 | 64 | 22 |
| C-11 | 2.5/1 | 53 | 29 | 69 | 11 | 65 | 19 |
| 12 | 2.5/1 | 58 | 26 | 77 | 25 | 70 | 20 |
| C-13 | 2.5/1 | 59 | 17 | 74 | 31 | 65 | 19 |

Research conducted by the large manufacturers of carpet maintenance equipment has led to the development of "steam" cleaning as an alternative cleaning method for carpet and other textiles. This technique involves applying a hot surfactant solution to the carpet from a sprayer followed immediately by an industrial wet vacuum to extract the now dirt and soil laden shampoo solution. The generic term "steam" is somewhat misleading in that it is used to describe the use of hot tap water (130°-140° F.) without additional heating in the equipment.

A definitive experiment was designed to evaluate and compare "steam" cleaning to conventional scrubbing in cleaning efficacy and resoiling rate. A second objective was to compare the best competitive product, "Morton" SRP-30 and "Rinse n Vac", a product specifically designed for "steam" cleaning, against the best oligomeric and polymeric candidates. The "steam" cleaning evaluation was conducted using a "Rinse n Vac" machine using a shampoo concentration of 2 oz./gal. The scrubbing evaluation employed a level of 3.84 oz./gal.

The data presented in Table IV detail the results of cleaning efficacy and soil retardancy profiles of the various candidates applied via the two cleaning techniques. As may be seen from the data for the presoiled carpet, the oligomeric candidate demonstrated the best cleaning efficacy using the "steam" cleaner while the emulsion polymer candidate performed the best using the conventional scrubbing apparatus and demonstrated a slight advantage over the others in soil resistance using the "steam" cleaner.

In tests conducted on pretreated carpet the emulsion candidate demonstrated a slight soil retardancy performance advantage over the other three products using the "steam" cleaner and was clearly superior to the others using the conventional scrubbing system.

TABLE IV

Comparative Service Soiling and Cleaning Evaluation

A. Presoiled Carpet

| Example | Steam Cleaner First Cleaning % Cleaning | Steam Cleaner First Cleaning Subjective | Steam Cleaner Resoil % Soil Retardancy | Steam Cleaner Resoil Subjective | Conventional Scrubbing First Cleaning % Cleaning | Conventional Scrubbing First Cleaning Subjective | Conventional Scrubbing Resoil % Soil Retardancy | Conventional Scrubbing Resoil Subjective |
|---|---|---|---|---|---|---|---|---|
| C-14 (Rinse n Vac) | 33 | 12 | 11 | 8 | 0 | 8 | −92 | 8 |
| C-11 (Morton SRP-30*) | 51 | 20 | 19 | 26 | 19 | 16 | 29 | 16 |
| 12* | 50 | 16 | 21 | 29 | 34 | 32 | 36 | 32 |
| C-13* | 55 | 32 | 14 | 17 | 35 | 24 | 35 | 24 |

TABLE IV-continued

Comparative Service Soiling and Cleaning Evaluation

B. Pretreated Carpet

| | Steam Cleaner First Soiling | | Conventional Scrubbing First Soiling | |
|---|---|---|---|---|
| Example | % Soil Retardancy | Subjective | % Soil Retardancy | Subjective |
| C-14 | 14 | 10 | −95 | 10 |
| C-11 | 17 | 14 | 15 | 16 |
| 12* | 19 | 30 | 38 | 31 |
| C-13* | 21 | 26 | 30 | 25 |

*Formulated at 2.5/1 ratio of modifier to SLS.

There is a positive effect in soil retardancy as molecular weight increases from ~1000 to ~2500. Cleaning efficacy data in Table V shows a decrease in performance at a molecular weight >200,000. It is theorized that this may be a direct result of the increased viscosity of the formulation, yielding poor penetration and soil removal. Molecular weight control is essential to insure that shampoo formulations are of workable viscosities.

TABLE V

Molecular Weight Series - MMA/MAA//80/20, 2.5/1 Modifier/SLS

| | | Percent Soil Retardancy | | Percent Cleaning |
|---|---|---|---|---|
| Example | $\overline{M}n$ | Initial | Resoil | Initial |
| C-13 | 2,500 | 35 | 16 | 66 |
| C-15 | ~70,000 | 34 | 13 | 68 |
| C-16 | >200,000 | 36 | 15 | 61 |

Note that no BA is used, nor is metal crosslinking used. Nevertheless, the molecular weight significance is apparent.

Comparative performance data herein presented has demonstrated the carpet shampoo soil retardancy offered by the polymer of Ex. C-13. However, it should be noted that the viscosity of this product at 20 percent solids may be too high for current production capability. Greater dilutions allow its use, however.

TABLE VI

Viscosity Profiles

| Example | Composition | Percent Solids | T °C. | η |
|---|---|---|---|---|
| 12-1 | BA/St/MAA-/25/25/50 + 1 eq $Zn^{++}$ | 19.5 | 22 | 10100 |
| 12-2 | BA/St/MAA//25/25/50 + 1 eq $Zn^{++}$ | 19.5 | 55 | 1800 |

A series of high Tg acrylic emulsion polymers varying in molecular weight was synthesized to identify the effect of this parameter on carpet soil retardancy and cleaning efficacy. It may be concluded from the data in Table VI that increasing the molecular weight from ·2500 to 200,000 does not offer any increase in soil retardancy.

It is theorized that because of the high zinc crosslink density of these systems resulting in a high apparent Tg (>100° C.) of the dried polymer film, the Tg contribution of the comonomers is not intrinsic to performance. Studies conducted with these systems have shown that modifiers that demonstrated poor soil retardancy also exhibit marginal solution stability as the liquid concentrate and when formulated with typical carpet shampoo surfactants such as sodium lauryl sulfate. Analysis of precipitates observed in these systems has identified them as insoluble zinc polymer matrices and zinc lauryl sulfate. These analytical findings indicate that the zinc complex is not stable in these polymer systems and does not crosslink during drying, thus resulting in poor soil retardancy.

In order to establish the causality between stability of the modifier in solution and its soil retardancy performance, two key solution properties of the polymers were investigated. The solubility parameter of each polymer was calculated using Small's Rule and the pka of each raw emulsion polymer was also experimentally determined before the zinc complex was added. Details of these results are listed in Table VII which compare composition, solubility parameter (Δ), pka, stability of the modifier in solution at 20% and formulated 2.5/1 with SLS at 9%, and relative soil retardancy performance. It may be seen from this data that a direct relationship exists between pka of less than 6.7, formulation compatibility and soil retardancy while no discernible relationship exists between solubility parameter and performance. An observed exception is the EA analog which has a low pka (6.50) and good solubility but because of its relative hydrophilic nature demonstrates poor soil retardancy. It is known that pka, a measurement of the relative acid strength of the polymer, is altered by the stearic and electronic effects of comonomers on these acid modifiers as well as by the sequence of monomer addition to the backbone. It is theorized that low pka polymers having stronger acid functionality demonstrate improved compatibility with the zinc complex in solution and allow more effective ionic crosslinking of the polymer when dried. This is observed as an increase in solution stability and soil retardancy of the carpet.

TABLE VII

Solubility Parameters, pka, Solution Stability and Performance of Select Shampoo Modifier Emulsions

| | | | | Solution Stability | | Relative |
|---|---|---|---|---|---|---|
| Example | Composition | Solubility Parameter | pka | Concentrate 20% | 2.5/1 w/SLS 9% | Soil Retardancy |
| C-17 | EA/MAA//50/50 | 10.97 | 6.50 | Stable | Stable | Poor |
| 18 | BA/St/MAA//25/25/50 | 10.90 | 6.68 | Stable | Stable | Excellent |
| 19 | BA/MAA//50/50 | 10.85 | 6.53 | Stable | Stable | Excellent |

TABLE VII-continued

Solubility Parameters, pka, Solution Stability and Performance of Select Shampoo Modifier Emulsions

| Example | Composition | Solubility Parameter | pka | Solution Stability Concentrate 20% | Solution Stability 2.5/1 w/SLS 9% | Relative Soil Retardancy |
|---|---|---|---|---|---|---|
| 20 | BA/St/MMA/MAA//25/15/10/50 | 10.91 | 6.69 | Stable | Stable | Good |
| C-21 | BA/MMA/MAA//25/25/50 | 10.93 | 6.85 | Stable | Marginal | Fair |
| C-22 | BMA/MAA//50/50 | 10.76 | 7.51 | Unstable | Unstable | Fair |
| C-23 | MMA/St/MAA//25/25/50 | 10.98 | 7.68 | Unstable | Unstable | Fair |

It has been previously shown in Table I that the Example 5 BA/St analog demonstrated the best performance profile of any experimental system evaluated in that table. However, the viscosity of this polymeric modifier at 20% solids and 35° C. was 6500 cps, a viscosity unacceptable for production implementation at that dilution level. A goal was established requiring a product viscosity of >1500 cps at 35° C. with a minimum product solids of 25%. An acceptable product solids/viscosity profile was achieved through the selection of a molecular weight control agent.

A study was conducted to identify the preferred chain transfer agent and level to achieve a product with acceptable viscosity. Data presented in Table VIIIA demonstrates that an acceptable viscosity profile may be achieved with either 1.0% 3-MPA[1] or 3.0% BTM[2]. However, comparative resoil retardancy and cleaning efficacy results show that the 3% BTM system demonstrates a performance advantage over the 3-MPA analog. The 3-MPA analog also yielded low conversion during polymerization and was eliminated from further study.

[1] 3-MPA = 3-mercapto propionic acid
[2] BTM = bromotrichloromethane

A polymer of BA/St/MAA//25/25/50 was prepared using the preferred 3% BTM chain transfer agent previously identified. Unfortunately, as may be seen in Table VIIIB, this analog had a viscosity of 4900, less than the 2% BTM analog, but still unacceptable for plant practice. The dramatic increase in viscosity over the styrene free system was due to the steric and electronic effects of the incorporation of styrene into the polymer backbone.

BTM chain transfer agent levels above 3% have only a minor effect on molecular weight reduction. Therefore, to further reduce viscosity an analog was prepared using 3% BTM but containing BA/St//40/10 as opposed to BA/St//25/25. Comparative performance detailed in Table VIIIB shows that only a very minor compromise in soil retardancy is seen from reducing the styrene level from 25 to 10 percent with no adverse effect on cleaning. Product viscosity requirements are surpassed by this system.

TABLE VIII

Effect of Molecular Weight Control Agent Selection on Performance
All Systems 2.5/1 Modifier/SLS
1.0 eq. $Zn^{++}$ Complexed With Ammonium

A.

| Sample | Composition | Chain Transfer Agent | Viscosity 25% TS 35° C. (cps) | % Soil Retardancy Initial | % Soil Retardancy Resoil | % Cleaning Initial |
|---|---|---|---|---|---|---|
| 24 | BA/MAA//50/50 | 3% BTM | 1300 | 57 | 52 | 61 |
| 25 | BA/MAA//50/50 | 1% 3-MPA | 1490 | 56 | 48 | 57 |
| 26 | BA/MAA//50/50 | 1.25% BTM | 2700 | 55 | 47 | 57 |
| 27 | BA/MAA//50/50 | 2% BTM | 1900 | 55 | 48 | 56 |

B.

| Sample | Composition | Chain Transfer Agent | Viscosity (cps) | % Soil Retardancy Initial | % Soil Retardancy Resoil | % Cleaning Initial | % Cleaning Reclean |
|---|---|---|---|---|---|---|---|
| 24 | BA/MAA//50/50 | 3% BTM | 1300 | 47 | 53 | 55 | 85 |
| 28 | BA/St/MAA//25/25/50 | 3% BTM | 4900 | 53 | 58 | 64 | 86 |
| 29 | BA/St/MAA//25/25/50 | 2% BTM | 6500 | 54 | 59 | 62 | 87 |
| 30 | BA/St/MAA//40/10/50 | 3% BTM | 700 | 53 | 56 | 63 | 87 |

Based on the viscosity reduction observed by lowering the styrene level, further bench evaluations using 3% BTM and varying the styrene level from 0–25% were conducted. Data presented in Table IXA shows that increasing soil retardancy and cleaning efficacy is realized as the styrene level increases to 15% and is comparable to the 25% styrene 2% BTM standard. The 15% styrene analog demonstrates a viscosity still within acceptable limits. Table IXB shows essentially no change in initial and resoil retardancy between 15% and 25% styrene with some slight improvement in cleaning with increasing styrene level at 3% BTM. It may be seen that the 20% styrene analog, having a viscosity of 2750 at 25% solids, is unacceptable for plant scale up. Therefore, the preferred styrene level based on performance and viscosity considerations is about 15 percent. The soil retardancy and cleaning tests are described above in connection with Table I.

Recent toxicological findings have raised questions concerning the toxicity of BTM and its decomposition product, chloroform. Because of these potential problems, a study was conducted to replace the BTM using an alternative copper chloride, hydrazine, t-butyl hydrogen peroxide (t-BHP) catalyst/molecular weight control system.

An intense synthetic effort yielded a BA/St/MAA//35/15/50 analog using a copper chloride, hydrazine, t-BHP molecular weight control system which offered a viscosity profile within acceptable limits. Based on the data presented in Table IXC, this analog (Ex. 34) offers a modest improvement in initial soil retardancy over the EX.12-3 standard with a greatly reduced viscosity through lower molecular weight versus its 3% BTM analog. Other performance properties are comparable within experimental limits.

In another study, styrene level was compared to product viscosity at various solids. The dramatic viscosity building effects of styrene was seen at 30% solids where 0% styrene yielded a viscosity of 1300 cps while 25% styrene gave 4900 cps. A viscosity reduction achieved by the copper hydrazine/t-BHP system at 15% styrene versus its 3% BTM analog was also apparent. The depression in viscosity observed between the styrene free and 10% styrene analog is believed to be caused by synthesis parameter adjustments (i.e., emulsifier level, emulsion particle size or monomer addition rate) rather than being a direct consequence of styrene incorporation.

It was concluded that the copper hydrazine/t-BHP system offering reduced product viscosity through improved chain transfer efficiency and a lower toxicity profile is the system of choice for molecular weight control. Fifteen percent styrene is the level necessary for optimized performance at acceptable product viscosity.

TABLE IX

Effect of Styrene Level on Modifier Performance
All Systems 2.5/1 Modifier/SLS
1.0 eq. $Zn^{++}$ (*ammonia*)

| Example | Composition | Chain Transfer Agent | Viscosity 35° C. 25% TS | % Soil Retardancy Initial | % Soil Retardancy Resoil | % Cleaning Initial |
|---|---|---|---|---|---|---|
| A. | | | | | | |
| 24 | BA/MAA//50/50 | 3% BTM | 600 | 44 | 44 | 51 |
| 30 | BA/St/MAA//40/10/50 | 3% BTM | 350 | 46 | 47 | 63 |
| 31 | BA/St/MAA//35/15/50 | 3% BTM | 1200 | 52 | 50 | 62 |
| 12-3 | BA/St/MAA//25/25/50 | 2% BTM | 6500 | 53 | 51 | 63 |
| B. | | | | | | |
| 31 | BA/St/MAA//35/15/50 | 3% BTM | 1200 | 53 | 49 | 65 |
| 32 | BA/St/MAA//30/20/50 | 3% BTM | 2750 | 53 | 50 | 68 |
| 33 | BA/St/MAA//25/25/50 | 3% BTM | 4000 | 53 | 49 | 70 |
| 12-3 | BA/St/MAA//25/25/50 | 2% BTM | 6500 | 54 | 49 | 67 |
| C. | | | | | | |
| 30 | BA/St/MAA//40/10/50 | 3% BTM | 350 | 53 | 55 | 66 |
| 31 | BA/St/MAA//35/15/50 | 3% BTM | 1200 | 54 | 54 | 71 |
| 12-3 | BA/St/MAA//25/25/50 | 2% BTM | 6500 | 54 | 54 | 69 |
| 34 | BA/St/MAA//35/15/50 | $Cu^{++}$ Hydrazine t-BHP | 700 | 58 | 54 | 68 |

It should be noted that preparation of these zinc polyacrylates is relatively straightforward. The emulsion polymer is prepared at about 40% solids via standard techniques and is solubilized with aqueous ammonia. An excess charge of ammonia permits zinc oxide to be dissolved in situ as the zinc ammonium complex. The resulting product can be easily supplied at about 20–25% solids.

A series of systems was prepared to identify the effect of various comonomers on soil retardancy performance when incorporated into high MAA zinc-containing backbones. Detailed below in Table X are the results which show that higher Tg comonomers offer improved soil retardancy. Included for control purposes is Example C-10, "Vanguard" (T.M.), a competitive shampoo identified as one of the best soil retardant products available. It is noteworthy that the BA and BA/St analogs demonstrate superior performance.

TABLE X

Effect of Comonomers on Performance

| Example | Composition | Zinc Level | Percent Soil Retardancy Initial | Percent Soil Retardancy Resoil | Percent Cleaning Initial |
|---|---|---|---|---|---|
| C-10 | MMA/MAA | — | −7 | −12 | 51 |
| C-35 | HEMA/MAA//50/50 | 1 eq | −230 | −230 | 60 |
| 36 | BA/MAA//50/50 | 1 eq | 12 | 8 | 50 |
| 12 | BA/St/MAA//25/25/50 | 1 eq | 23 | 22 | 55 |

Several other candidates were compared to confirm the Tg/soil retardancy effect previously observed. All formulations contained one equivalent of zinc although the acid levels varied. A comparison of the first two analogs listed in Table XI demonstrates the positive performance in soil retardancy offered by incorporation of the higher Tg monomers, styrene and MMA over the softer and more hydrophylic EA. Of noteworthy interest is their poor cleaning performance relative to the other formulations. It is believed that this is a result of their extremely high molecular weight, thus preventing adequate penetration of the shampoo solution into the fibers.

TABLE XI

Comonomer Incorporation into Shampoo Modifiers - 2.5/1 Modifiers/SLS

| Example | Composition | MW | Cross-linker | Percent Soil Retardancy Initial | Percent Soil Retardancy Resoil | Percent Cleaning Initial |
|---|---|---|---|---|---|---|
| C-37 | EA/MAA//30/70 | >200,000 | 1 eq $Zn^{++}$ | 40 | 44 | 35 |
| C-38 | St/MMA/-MAA//28/5/68 | >200,000 | 1 eq $Zn^{++}$ | 63 | 55 | 30 |
| C-39 | poly MAA | ~70,000 | 1 eq $Zn^{++}$ | 25 | 56 | 70 |
| 12 | BA/St/MAA//25/25/50 | ~50,000 | 1 eq $Zn^{++}$ | 51 | 58 | 68 |

Using the polymer of Example 34, made with the copper hydrazine chain transfer system, an actual floor test was conducted to demonstrate its overall performance versus the best competitive polymer previously identified, Morton SRP-30 (Example C-11). From the results of these evaluations detailed in Table XII it was concluded that the polymer of Example 34 clearly demonstrated better overall soil retardancy and cleaning efficacy over the competitive product. These results were confirmed both by the subjective panel evaluation and instrumental analysis.

TABLE XII

Service Soiling and Cleaning Evaluation (Modifier/SLS//2.5/1) 1.0 eq $Zn^{++}$ (ammonia)

A. Presoiled Test (Sequence: presoiled, shampooed, evaluated, resoiled, evaluated)

| | Cleaning | | Resoiling | |
|---|---|---|---|---|
| Example | % Cleaning | Subjective | % Soil Retardancy | Subjective |
| C-11 | 11 | 16 | 21 | 17.5 |
| 34 | 23 | 24 | 45 | 22.5 |
| Untreated | — | 8 | — | 8 |

B. Pretreated Test (Sequence: pretreated, soiled, evaluated)

| | Soil Retardancy | |
|---|---|---|
| Example | % Soil Retardancy | Subjective |
| C-11 | 11 | 16 |
| 34 | 18 | 24 |
| Untreated | — | 8 |

Subjective Rating: 8 = worst; 24 = best

Since each equivalent of zinc requires four of ammonia to complex the cation, reduction of the zinc level will reduce the ammonia requirement and produce an ameliorating effect on product odor.

Detailed in Table XIII are the results of a bench evaluation study to screen the effects of zinc level on performance. It was concluded that improved soil retardancy and cleaning are afforded by increasing the zinc level to 1.0 equivalents. The copper hydrazine/t-BHP analog, again confirms an initial soil retardancy and recleaning performance advantage over APS/BTM.

Table XIII compares soil retardancy and cleaning efficacy of analogs of the identified preferred composition at zinc levels from 0.8 to 1.0 equivalents. Initial and resoil retardancy increases through 0.9 equivalents with higher levels being comparable within experimental error. It was concluded that 0.95 equivalents of zinc is optimum. This level will provide a tolerance of ±5% zinc without any adverse effect on performance.

Because of the high level of zinc used in this system and its fourfold ammonia requirement, a possibly objectionable property is a strong ammoniacal odor. In plant practice high ammonia levels may require special handling, thus increasing manufacturing and processing costs. A strong odor of the modifier concentrate may also be objectionable to a potential formulator. To this end, a study was conducted to evaluate the replacement of the ammonia used to complex the zinc with less odiferous but equally effective ammonium bicarbonate.

Based on the test results detailed in Table XIIIC, it may be concluded that the ammonium hydroxide analog demonstrates a comparable overall soil retardancy profile to the ammonium bicarbonate candidate. Soil retardancy values of this series are somewhat lower than in previous tests owning to an anomalous increase in temperature of the conditioning chamber. Subjective odor evaluations confirm a dramatic reduction in ammonia odor of the ammonium bicarbonate system.

TABLE XIII

Carpet Shampoo Modifier Performance (BA/St/MAA//35/15/50)

A. Initiator/Zinc Level (2.5/1 Modifier/SLS)

| | | | Soil Retardancy | | % Cleaning | |
|---|---|---|---|---|---|---|
| Example | Initiator | Zinc (eq) | Initial | Resoil | Initial | Reclean |
| 40 | APS/BTM | 1.0 | 58 | 61 | 66 | 79 |
| 41 | Cu Hyd | 1.0 | 64 | 60 | 65 | 83 |
| 42 | Cu Hyd | 0.75 | 60 | 55 | 63 | 81 |
| 43 | Cu Hyd | 0.50 | 50 | 53 | 62 | 74 |

B. Zinc Level Study (All Samples Cu Hydrazine Initiator)

| | | % Soil Retardancy | | % Cleaning | |
|---|---|---|---|---|---|
| Example | Zinc Level | Initial | Resoil | Initial | Reclean |
| 41 | 1.0 eq | 52 | 48 | 49 | 78 |
| 44 | 0.95 | 51 | 51 | 51 | 81 |
| 45 | 0.90 | 52 | 49 | 52 | 83 |
| 46 | 0.85 | 49 | 38 | 52 | 82 |
| 47 | 0.80 | 47 | 36 | 51 | 82 |

C. Ammonia vs. Ammonium Bicarbonate (All Samples Cu Hydrazine Initiator)

| | | | % Soil Retardancy | | % Cleaning | |
|---|---|---|---|---|---|---|
| Example | Zinc Level | Base | Initial | Resoil | Initial | Reclean |
| 41 | 1.0 eq | $NH_4OH$ | 32 | 38 | 49 | 85 |
| 48 | 1.0 eq | $NH_4HCO_3$ | 31 | 39 | 53 | 82 |
| 44 | 0.95 eq | $NH_4OH$ | 28 | 40 | 52 | 83 |
| 49 | 0.95 eq | $NH_4HCO_3$ | 30 | 38 | 49 | 84 |

A service soiling and cleaning study was conducted to confirm the bench findings which demonstrated ammonium bicarbonate to be an acceptable substitute ligand source for ammonium hydroxide and copper/hydrazine/t-BHP to be acceptable in place of APS/BTM. Table XIV details the results of a floor test conducted in a manner described earlier.

In Table XIVA the test carpet was first presoiled followed by shampooing with the candidates and evaluated for cleaning efficacy. In Table XIVB using pretreated carpet to determine soil retardancy, again the two chain transfer systems are found to demonstrate comparable soil retardancy under traffic. A second soil retardancy test was conducted to compare the new preferred composition (Example 44) containing 0.95 equivalents of Zn++ versus the standard (Example 34). As may be seen from this data in Table XIVC, the two systems are comparable in soil retardancy. All polymers in Table XIV are BA/St/MAA in the weight ratio of 35/15/50.

TABLE XIV (All Formulations 2.5/1 Modifiers/SLS)

A. Presoiled Test (Sequence: soiled, shampooed, evaluated)

| Example | Zinc Level | Ligand | Initiator/ M. W. Control | Cleaning % Cleaning | Cleaning Subjective |
|---|---|---|---|---|---|
| 34 | 1.0 eq | $NH_4OH$ | APS/BTM | 34 | 27 |
| 48 | 1.0 eq | $NH_4HCO_3$ | Cu/Hyd/t-BHP | 36 | 24 |
| 45 | 0.9 eq | $NH_4OH$ | Cu/Hyd/t-BHP | 32 | 21 |
| Untreated | — | — | — | 0 | 8 |

B. Pretreated Test (Sequence: pretreated, soiled, evaluated)

| Example | Zinc Level | Ligand | Initiator/ M. W. Control | Soil Retardancy % Soil Retardancy | Soil Retardancy Subjective |
|---|---|---|---|---|---|
| 34 | 1.0 eq | $NH_4OH$ | APS/BTM | 30 | 26 |
| 48 | 1.0 eq | $NH_4HCO_3$ | Cu/Hyd/t-BHP | 28 | 24 |
| 45 | 0.9 eq | $NH_4OH$ | Cu/Hyd/5-BHP | 27 | 22 |
| Untreated | — | — | — | 0 | 8 |

C. Pretreated Test (Sequence: pretreated, soiled, evaluated)

| Example | Zinc Level | Ligand | Initiator/ M. W. Control | Soil Retardancy % Soil Retardancy | Soil Retardancy Subjective |
|---|---|---|---|---|---|
| 34 | 1.0 eq | $NH_4OH$ | APS/BTM | 23 | 29 |
| 44 | 0.95 eq | $NH_4HCO_3$ | Cu/Hyd/t-BHP | 24 | 27 |
| 49 | 0.90 eq | $NH_4HCO_3$ | Cu/Hyd/t-BHP | 23 | 16 |
| Untreated | — | — | — | 0 | 8 |

(32 = best
8 = poorest)

The modifier composition prepared in Part C above (Example 49) was compared in carpet shampoo formulations in floor service tests against a fluorinated acrylic and an acrylic copolymer modifier. In this investigation the carpet sample was shampooed with the test formulation using a rotary scrubber, permitted to dry for 16 hours, vacuum cleaned, soiled under heavy foot traffic for two weeks and evaluated for soil retardancy. A second carpet sample was initially soiled under heavy foot traffic for two weeks, shampooed and measured for cleaning efficiency. The carpet was again subjected to two weeks of heavy foot traffic and evaluated for resoil retardancy.

In these test formulations the modifier/SLS ratio was 2.5/1, the SLS content was equivalent and the shampoo was applied at 2% solids. Measurements were made in the manner described prior to Table I above.

Table XV demonstrates superior soil retardancy and cleaning efficiency for modifiers of the invention (Example 49) over other commercial polymeric modifiers.

TABLE XV

CARPET SHAMPOO PERFORMANCE - FLOOR SERVICE

| Modifier | % Soil Retardancy | % Cleaning | % Resoil Retardancy |
|---|---|---|---|
| Untreated | 0 | 0 | 0 |
| None | −23 | 15 | −37 |
| Acrylic Copolymer | 45 | 22 | 7 |
| Fluorinated | | | |

TABLE XV-continued

CARPET SHAMPOO PERFORMANCE - FLOOR SERVICE

| Modifier | % Soil Retardancy | % Cleaning | % Resoil Retardancy |
|---|---|---|---|
| Acrylic | 47 | 26 | 26 |
| Example 49 | 58 | 38 | 37 |

In the tables, the polymers of Examples 5, 12, 12-1, 12-2 and 12-3 are the same, except as otherwise indicated.

We claim:

1. An aqueous composition useful for imparting improved soil retardancy to a surface and adapted to modify a carpet shampoo, consisting essentially of: (1) a polymer component comprising an aqueous dispersion of a low molecular weight acrylic addition polymer consisting essentially of copolymerized units of (a) butyl acrylate, (b) styrene, (c) methyl methacrylate, and (d) an acid monomer selected from the group consisting of methacrylic acid, acrylic acid, itaconic acid and any mixture of two or more thereof, in the ratio by weight of a/b/c/d of 20–60/0–25/0–15/40–60, the polymer having a number average molecular weight of from about 2,500 to about 100,000; (2) polyvalent metal ions; (3) ammonia or a volatile amine in an amount effective to solubilize the polymer; and (4) optionally an anion in the form of $CO_3^{=}$, $HCO_3^-$ or amino acid anion, in an amount effective to stabilize any complex formed with ingredients (2) and (3); the pka of the polymer component being less than about 6.7, there being no more than about 1 part of styrene to 1 part of butyl acrylate by weight, the pH of the composition being between about 7.5 and about 11, and there being at least about 0.8 equivalents of polyvalent metal ion per carboxyl group in the polymer and about 5–50% by weight of polymer solids in the composition.

2. The composition of claim 1 in which at least about 5% of styrene is present in the polymer, and the molecular weight of the polymer is about 10,000–70,000, there being at least 0.9 equivalents of polyvalent metal ion per carboxyl group in the polymer.

3. The composition of claim 2 wherein the equivalents of polyvalent metal ion per carboxyl group is $0.95 \pm 0.05$.

4. The composition of claim 2 in which the metal is zinc, an anion is present as $HCO_3^-$, the acid monomer in the polymer is methacrylic acid, and the viscosity of a 25% solids solution of the polymer in water, at 35° C., containing at least two equivalents of ammonium cation and at least one equivalent of zinc as zinc oxide, is below about 3,500 centipoises.

5. The composition of claim 4 in which said viscosity is below about 1,500 centipoises.

6. An aqueous carpet shampoo consisting essentially of (A) a detergent effective for cleaning a carpet, and, (B) an aqueous modifier composition useful for imparting improved soil retardancy to a carpet, consisting essentially of: (1) a polymer component comprising an aqueous dispersion of a low molecular weight acrylic addition polymer consisting essentially of copolymerized units of (a) butyl acrylate, (b) styrene, (c) methyl methacrylate, and (d) an acid monomer selected from the group consisting of methacrylic acid, acrylic acid, itaconic acid and any mixture of two or more thereof, in the ratio by weight of a/b/c/d of 20–60/0–25/0–15/-40–60, the polymer having a number average molecular weight of from about 2,500 to about 100,000; (2) polyvalent metal ions; (3) ammonia or a volatile amine in an amount effective to solubilize the polymer; and (4) optionally an anion in the form of $CO_3^=$, $HCO_3^-$ or amino acid anion in an amount effective to stabilize any complex formed with ingredients (2) and (3); the pka of the aqueous polymer component being less than about 6.7, there being no more than about 1 part of styrene to 1 part of butyl acrylate by weight, the pH of the composition being between about 7.5 and about 11, and there being at least about 0.8 equivalents of polyvalent metal ion per carboxyl group in the polymer and about 5–50% polymer solids in composition (B); wherein the weight ratio of detergent (A) to the solids of composition (B) is between about 90:10 and about 1:99.

7. The shampoo of claim 6 in which at least about 5% styrene is present in the polymer and the molecular weight of the polymer is about 10,000–70,000, there being at least 0.9 equivalents of polyvalent metal ion per carboxyl group in the polymer, and the detergent is anionic.

8. The shampoo of claim 7 wherein the equivalents of polyvalent metal ion per carboxyl group is $0.95 \pm 0.05$.

9. The shampoo of claim 7 in which the metal is zinc, an anion is present as a $HCO_3^-$, the acid monomer in the polymer is methacrylic acid, and the viscosity is of a 25% solids solution of the polymer in water, at 35° C., containing at least two equivalents of ammonium cation and at least one equivalent of zinc as zinc oxide, is below about 3,500 centipoises.

10. The composition of claim 9 in which said viscosity is below about 1,500 centipoises.

11. A method of cleaning a carpet comprising applying the shampoo of claim 6 to the carpet, and removing the residue including loosened soil.

12. A method of cleaning a carpet comprising applying the shampoo of claim 7 to the carpet, and removing the residue including loosened soil.

13. A method of cleaning a carpet comprising applying the shampoo of claim 9 to the carpet, and removing the residue including loosened soil.

14. The method of claim 11 wherein the shampoo applied to the carpet is dried on the carpet, and loose, dried shampoo is removed with said residue and soil.

15. A carpet cleaned by the method of claim 11, 12 or 13, said carpet containing a residuum of the shampoo effective to impart soil retardancy to said carpet.

* * * * *